US006912935B2

(12) United States Patent
Hsien

(10) Patent No.: US 6,912,935 B2
(45) **Date of Patent: *Jul. 5, 2005**

(54) PAWL CONTROL STRUCTURE RATCHET TOOLS

(76) Inventor: Chih-Ching Hsien, No. 367, Pei Yang Rd., Feng Yuan, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/195,537

(22) Filed: Jul. 16, 2002

(65) Prior Publication Data

US 2004/0011165 A1 Jan. 22, 2004

(51) Int. Cl.[7] ..... B25B 13/46
(52) U.S. Cl. ..... 81/63.2; 81/62; 192/43.2
(58) Field of Search ..... 81/60, 62, 63.2; 192/43.2

(56) References Cited

U.S. PATENT DOCUMENTS 3,269,496 A * 8/1966 Kilness ..... 192/43.2
5,231,903 A * 8/1993 Bockman, Jr. ..... 81/63.2
5,957,009 A * 9/1999 McCann ..... 81/63.2
6,516,692 B1 * 2/2003 Hsien ..... 81/63.2
6,609,444 B1 * 8/2003 Hsien ..... 81/63.2

* cited by examiner

*Primary Examiner*—James G. Smith

(57) ABSTRACT

A ratchet tool includes a head with an engaging member rotatably received in a hole in the head and a recess is defined in an inner periphery of the hole so as to receive a pawl therein. A chamber is defined in a side of the head and communicates with the recess. A knob is rotatably received in the chamber and a biasing member is connected between the pawl and the knob. The biasing member is a V-shaped member and includes two insertions which are connected to a side of the pawl, and a peak portion which is securely connected to a protrusion extending eccentrically from an inside of the knob. The pawl is shifted by the biasing member when rotating the knob.

1 Claim, 5 Drawing Sheets

PAWL CONTROL STRUCTURE RATCHET TOOLS

FIELD OF THE INVENTION

The present invention relates to a pawl control structure of a ratchet tool. The pawl is connected to a biasing member which is eccentrically connected to a knob which is able to be rotated to shift the pawl.

BACKGROUND OF THE INVENTION

A conventional pawl shifting device for shifting the pawl to engage with the teeth of the engaging member so as to control the effective direction to rotate of the ratchet tool is located in the tool and cannot be accessed. When the pawl is shifted to one direction, the ratchet tool may output a torque in one direction, vice versa. Generally, the pawl has a protrusion at a rear end thereof and the selection member has a shifting portion which pushes the protrusion and shifts the pawl. The user has to exert a large force to shift the pawl.

The present invention intends to provide a pawl control structure that uses a biasing member connected to a side of the pawl and the biasing member is eccentrically connected to a knob which is rotated by the user to shift the pawl.

SUMMARY OF THE INVENTION

In accordance with one aspect of the present invention, there is provided a ratchet tool which comprises a head with a hole for receiving an engaging member therein and a recess is defined in an inner periphery of the hole so as to have a pawl therein. A chamber is defined in a side of the head and communicates with the recess.

The pawl is matched with the engaging member and two engaging holes is defined in a side of the pawl. A V-shaped biasing member has two insertions engaged with the engaging hole in the pawl, and a peak portion. A knob is rotatably engaged with the chamber and has a protrusion extending eccentrically from an inside of the knob. The protrusion is securely engaged with the peak portion of the biasing member.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
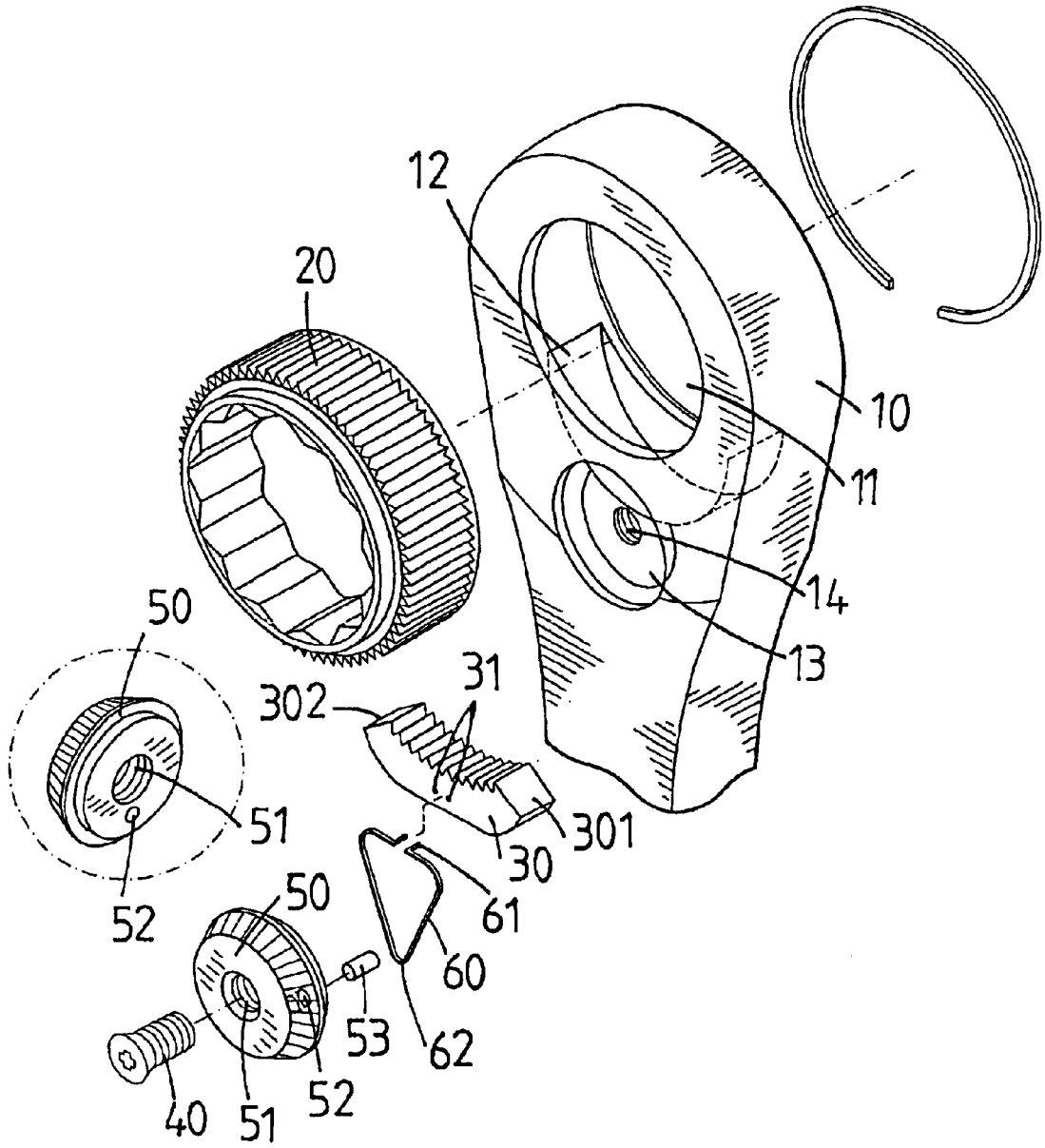
FIG. 1 is an exploded view to show the ratchet tool of the present invention.
Figure 2:
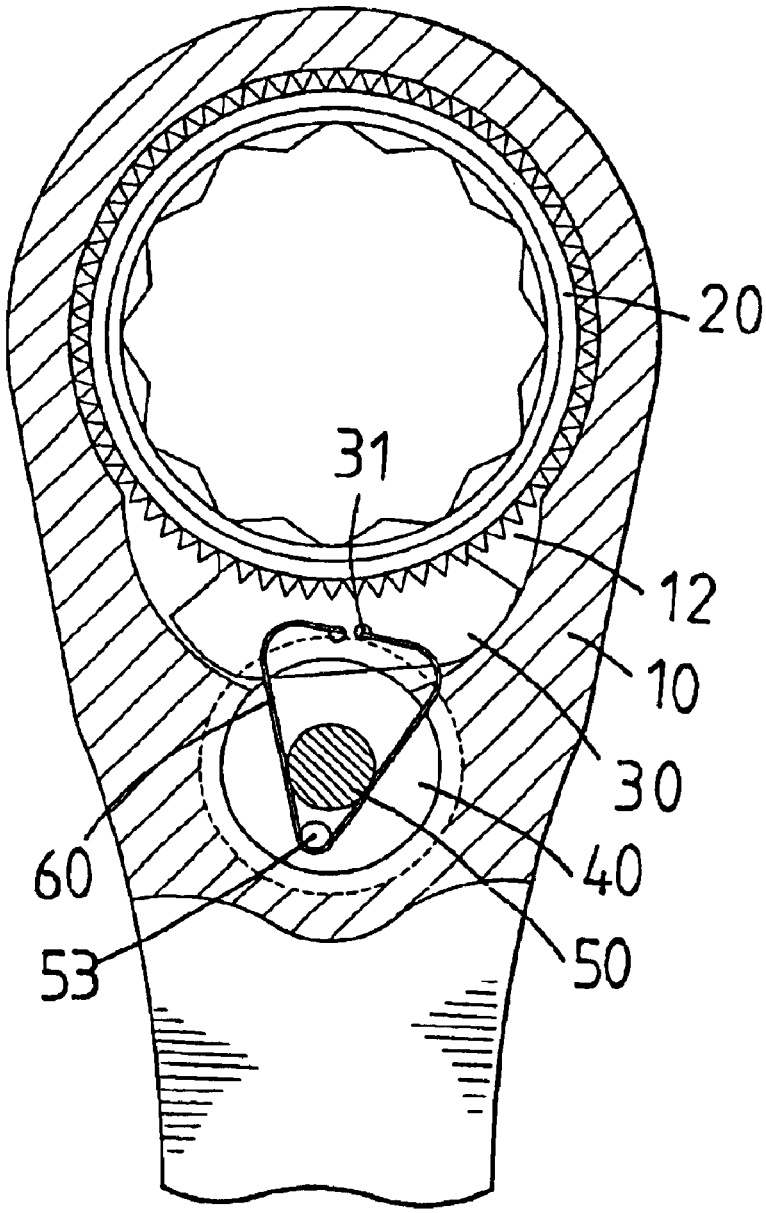
FIG. 2 is a cross sectional view to show the ratchet tool of the present invention, wherein the pawl is moved to the right.

Referring to FIGS. 1, 2, 4 and 5, the ratchet tool of the present invention comprises a head 10 having a hole 11 defined therethrough and a recess 12 defined in an inner periphery of the hole 11. An engaging member 20 is rotatably received in the hole 11 and has a toothed outer periphery. A chamber 13 is defined in a side of the head 10 and communicates with the recess 12.

A pawl 30 is movably received in the recess 12 and has a toothed surface which is matched with the toothed outer periphery of the engaging member 20. Two engaging holes 31 are defined in a side of the pawl 30.

A biasing member 60 is bent into a V-shaped configuration and includes two insertions 61 and a peak portion 62. The two insertions 61 are engaged with the engaging holes 31 in the pawl 30.

A knob 50 is rotatably engaged with the chamber 13 by extending a bolt 70 through a passage 51 in the knob 50 and being engaged with a threaded hole 14 defined in an inside of the chamber 13. A protrusion 53 extends eccentrically from an inside of the knob 50 and is securely engaged with the peak portion 62 of the biasing member 60.

Figure 4:
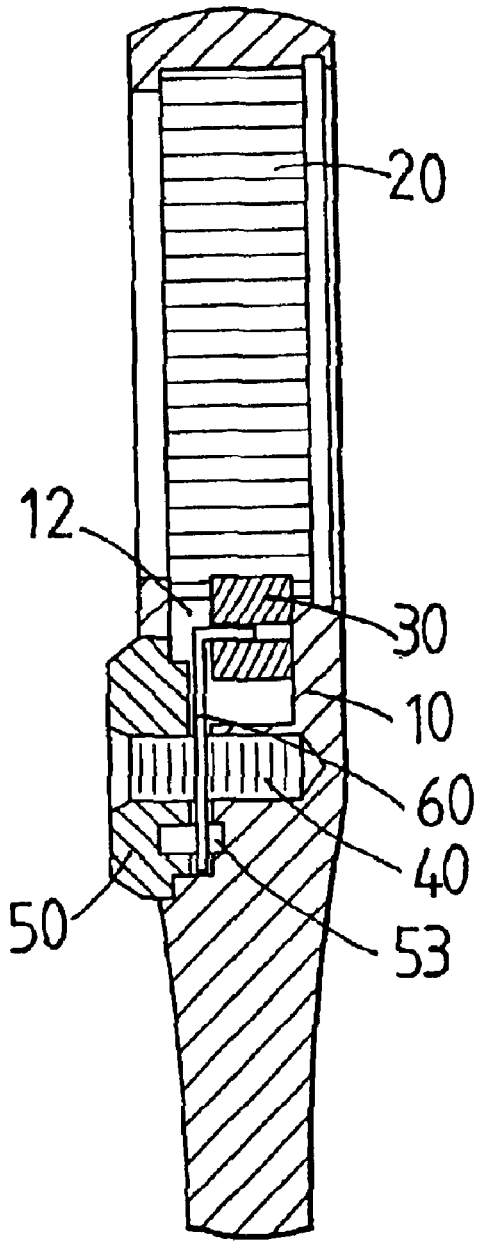
FIG. 4 is a side cross sectional view to show the ratchet tool of the present invention.
Figure 5:
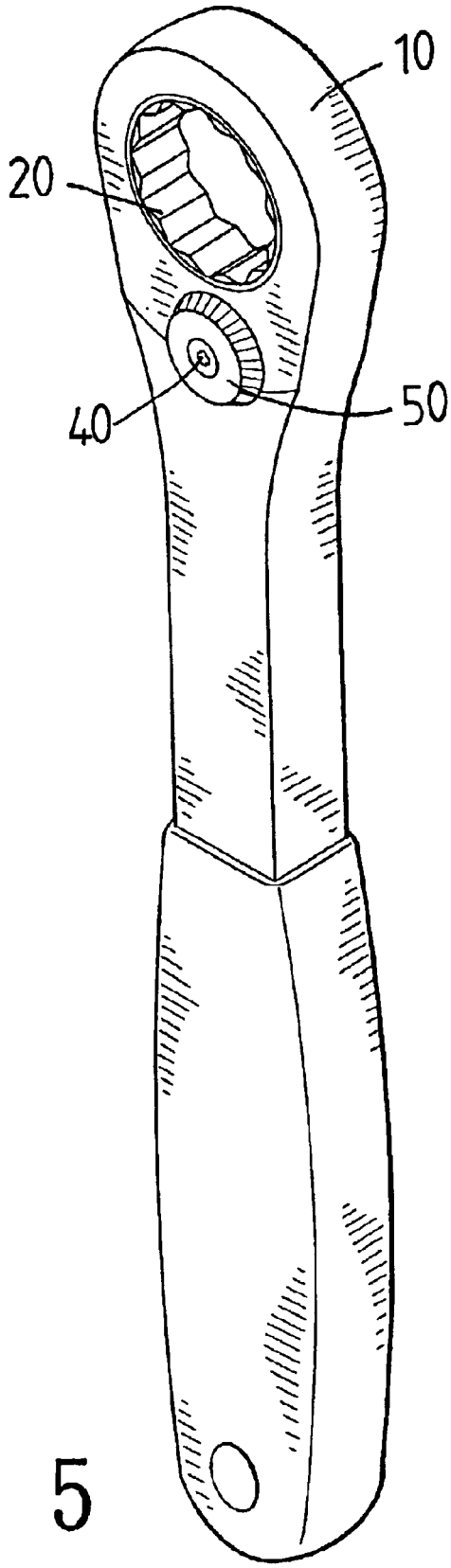
FIG. 5 is a perspective view to show the ratchet tool of the present invention.

When rotating the knob 52 as shown in FIG. 4, a first end 301 of the pawl 30 contacts against the inside of the recess 12 so that the when rotating the ratchet tool counter clockwise, the ratchet tool outputs a torque to tighten or loosen an object.

Figure 3:
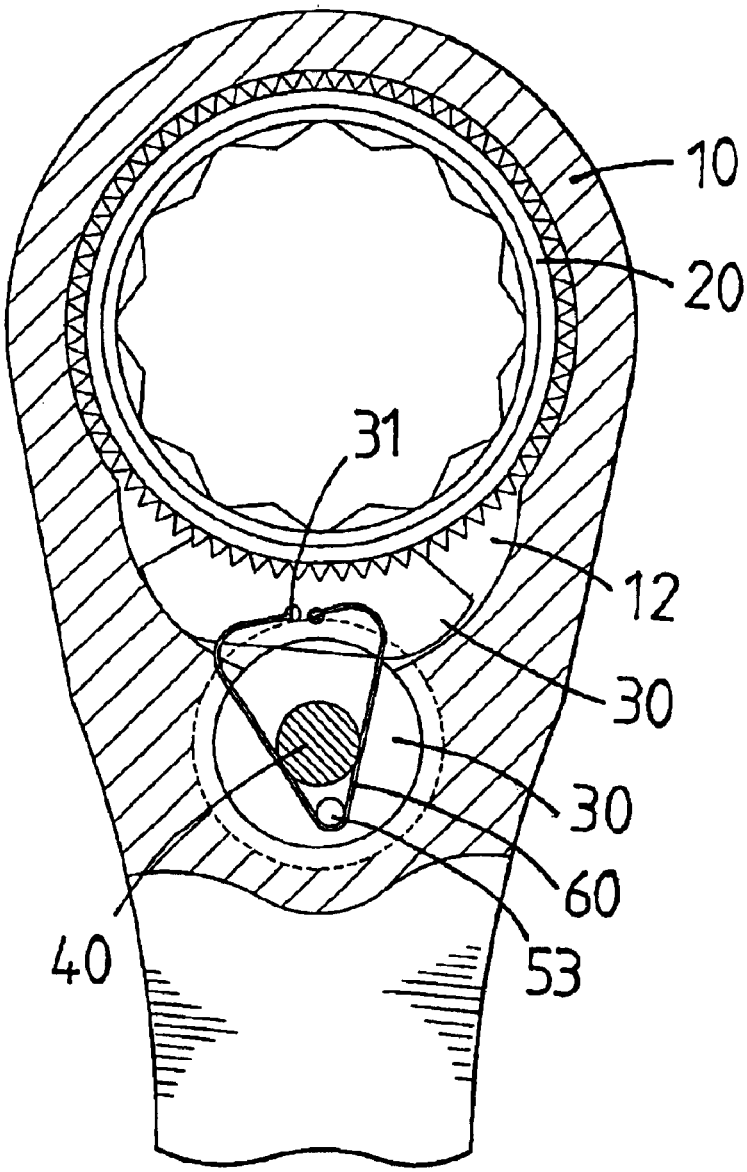
FIG. 3 is a cross sectional view to show the ratchet tool of the present invention, wherein the pawl is moved to the left.

Referring to FIG. 3, when rotating the knob 52 clockwise, a second end 302 of the pawl 30 contacts against the inside of the recess 12 so that the when rotating the ratchet tool clockwise, the ratchet tool outputs a torque to tighten or loosen an object.

The parts of the ratchet mechanism is easily accessed and maintained by unscrewing the bolt 40.

While we have shown and described the embodiment in accordance with the present invention, it should be clear to those skilled in the art that further embodiments may be made without departing from the scope of the present invention.

What is claimed is:

1. A ratchet tool comprising:

a head having a hole defined therethrough and a recess defined in an inner periphery of the hole, a chamber defined in a side of the head and communicating with the recess;

an engaging member rotatably received in the hole and having a toothed outer periphery;

a pawl movably received in the recess and having a toothed surface which is matched with the toothed outer periphery of the engaging member, two engaging holes defined in a side of the pawl, a V-shaped biasing member including two insertions and a peak portion, the two insertions engaged with the engaging holes in the pawl, and a knob rotatably engaged with the chamber and a threaded hole defined in an inside of the chamber, a bolt extending through the knob and engaged with the threaded hole, the knob having a protrusion extending eccentrically from an inside of the knob, the protrusion securely engaged with the peak portion of the biasing member.

* * * * *